United States Patent [19]

Bush

[11] 3,935,803

[45] Feb. 3, 1976

[54] AIR FILTRATION APPARATUS

[75] Inventor: Louis Bush, Beaufort, S.C.

[73] Assignee: Flanders Filters, Inc., Washington, N.C.

[22] Filed: Oct. 12, 1972

[21] Appl. No.: 296,846

[52] U.S. Cl. ..... 98/36; 55/473; 128/1 R

[51] Int. Cl.[2] ..... F24F 13/00

[58] Field of Search ..... 98/36, 40 D; 55/DIG. 29, 55/418, 356, 487, 473; 21/53, 74 R, 74; 128/1 R

[56] References Cited

UNITED STATES PATENTS

| | | | |
|---|---|---|---|
| 1,506,904 | 9/1924 | Harrison | 98/40 C |
| 2,198,419 | 4/1940 | Sutton | 98/36 X |
| 2,389,310 | 11/1945 | Hess | 98/40 C |
| 2,754,746 | 7/1956 | O'Brien | 98/36 |
| 3,170,385 | 2/1965 | Tompkins et al. | 98/36 |
| 3,256,799 | 6/1966 | Beckwith et al. | 98/36 |
| 3,270,655 | 9/1966 | Guirl et al. | 98/36 |
| 3,376,805 | 4/1968 | Deddo et al. | 98/40 D X |
| 3,385,036 | 5/1968 | Webb | 98/36 |
| 3,462,920 | 8/1969 | Denny | 98/36 X |
| 3,465,666 | 9/1969 | Knab | 98/40 D |
| 3,511,162 | 5/1970 | Truhan | 98/36 |
| 3,782,082 | 1/1974 | Smith et al. | 98/40 D |

*Primary Examiner*—William E. Wayner

*Attorney, Agent, or Firm*—Parrott, Bell, Seltzer, Park & Gibson

[57] ABSTRACT

A portable apparatus for directing a filtered stream of air downwardly over a predetermined area such as a hospital bed or the like. The apparatus includes a cantilevered plenum chamber adapted to be positioned horizontally over the bed, the plenum chamber comprising two segments hingedly interconnected so that the forward segment thereof may be dropped downwardly to facilitate movement and storage. The bottom wall of the plenum chamber comprises an openwork screen bounded by a peripheral slot, and a layer of filtering media overlies the screen such that a first portion of the air entering the plenum chamber is directed downwardly through the filtering media and screen at a relatively low velocity and in a substantially laminar flow pattern, and a second portion of the air is directed through the open slot to define a peripheral air curtain of relatively high velocity. The air curtain thereby serves to prevent the incursion of unfiltered air from the surrounding environment. The plenum chamber is tapered to achieve a substantially constant pressure drop along its length, and the inside lip of the slot is lower than the outside lip to direct the air curtain somewhat outwardly. The unit further includes a low resistance filter to filter the air entering the plenum chamber, the low resistance of the filter permitting the use of a relatively small blower which can be operated on conventional household current.

13 Claims, 10 Drawing Figures

AIR FILTRATION APPARATUS

The present invention relates to a portable air filtration apparatus for maintaining a clean room atmosphere at any desired work area, and more particularly to a high efficiency air filtration apparatus which is adapted to maintain a clean and nearly sterile atmosphere about a hospital bed to thereby protect a patient from the spread of infectious disease.

High efficiency air filters are known which are capable of removing extremely high percentages of submicron sized particles from the air. Specifically, such filters are commonly employed in industrial clean rooms which are used in the production of micro-electronic components, pharmaceuticals, food products, and many other processes.

Recently, it has been proposed to employ the clean room concept in the health care field to remove airborne bacteria from the environment of the patient to thereby reduce the danger of infection. However, such devices as have been proposed suffer from several disadvantages which have precluded their general acceptance. Specifically, the clean rooms in the health care field have been similar to those applied in industry, and because of this fact they are expensive and lack versatility. In addition, the patient often suffers a psychological problem resulting from the confinement associated with the close plastic sidewall curtains or glass walls, and such curtains or walls make physical and vocal communication between the hospital staff and the patient difficult. Also, maintenance of these enclosures in a sanitary condition requires considerable housekeeping labor.

It is accordingly an object of the present invention to provide a low cost, versatile air filtration apparatus which is suitable for supplying a particle free environment about a predetermined area such as a hospital bed.

It is a more specific object of the present invention to provide an apparatus for directing a filtered stream of air downwardly onto a hospital bed or the like, and with the periphery of the air stream moving at a higher velocity than the central portion thereof to thereby form an invisible peripheral air curtain along three of the four sides of the bed, the high velocity air curtain being designed to provide a barrier which prevents the incursion of unfiltered air into the area of the patient while maintaining free access to the patient.

It is another object of the present invention to provide a portable or mobile air filtration apparatus for use over a hospital bed and which is adapted to provide a substantially laminar flow pattern of air over the bed, and without the need for peripheral plastic curtains or glass walls.

It is a further object of the present invention to provide a portable air filtration apparatus for use in the health care field and wherein the apparatus may be folded into a configuration of reduced overall dimensions to facilitate movement from room to room such that the apparatus may be taken to the patient in any hospital room or used in a private home.

It is another object of the present invention to provide an air filtration apparatus of the described type having a tapered plenum chamber designed to maintain a substantially constant pressure along its length and thus a substantially uniform flow rate throughout the entire area of its perforated bottom wall.

It is still another object of the present invention to provide an air filtration device of the described type which is relatively small in size to permit movement in and out of rooms and elevators, and which is operable on standard household electrical current.

These and other objects and advantages of the present invention are achieved in the embodiment illustrated herein by the provision of an air filtration apparatus which comprises a horizontally disposed plenum chamber comprising a perforated bottom wall, and means defining a downwardly directed, continuous, open slot extending along each side and front end thereof. The plenum chamber further comprises two segments hingedly interconnected so that the forward segment thereof may be dropped downwardly to facilitate movement and storage. A frame is provided for supporting the plenum chamber in cantilever fashion above a hospital bed such that the plenum chamber is unsupported along its sides and front end. A vertical panel extends downwardly from the rear end of the plenum chamber such that the hospital bed is bounded by the vertical panel and an air curtain of high velocity air emanating from the slot of the plenum chamber.

Some of the objects and advantages of the invention having been stated, others will appear as the description proceeds, when taken in connection with the accompanying drawings, in which FIG. 1 is an isometric view of an air filtration apparatus embodying the present invention and disposed in operative position over a hospital bed;

Figure 1:
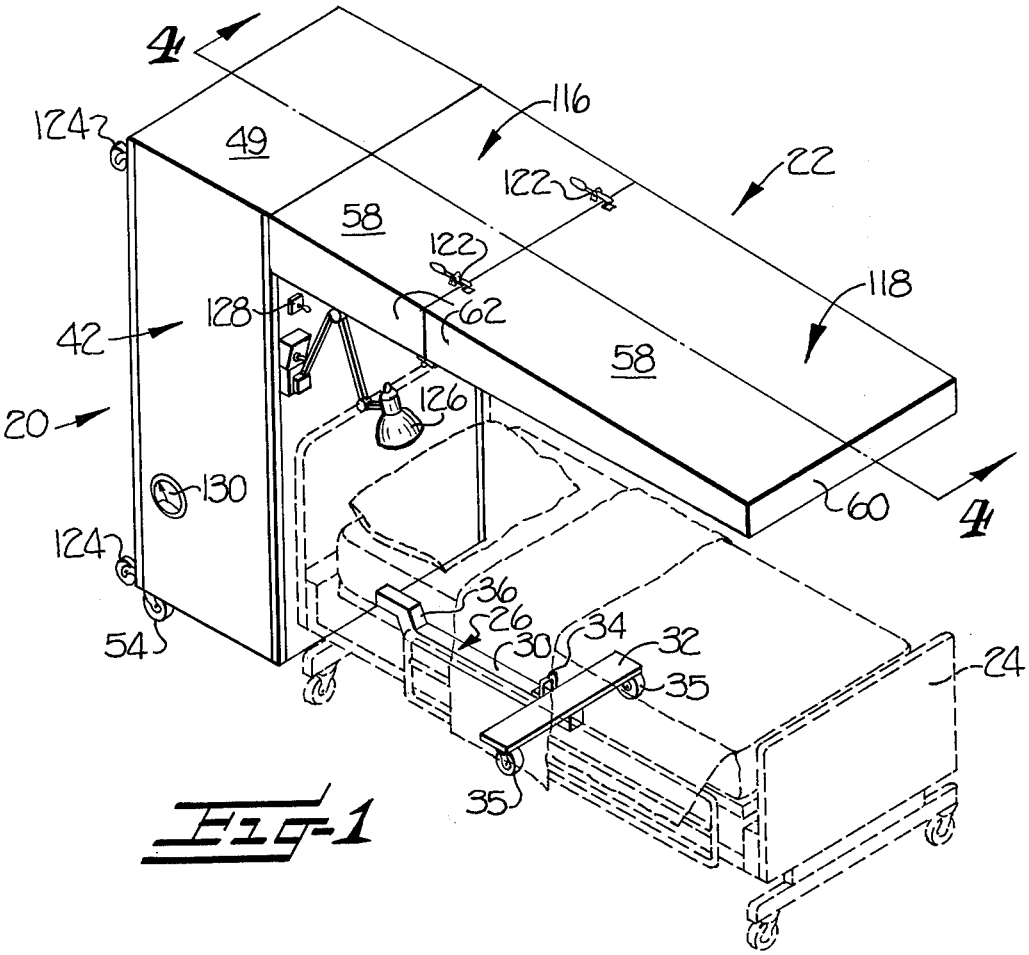

Referring more particularly to drawings, the illustrated air filtration apparatus is indicated generally at 20, and includes a horizontally disposed plenum chamber 22 adapted to be positioned above a hospital bed 24 or the like, in the manner shown in FIG. 1.

The air filtration apparatus further includes a supporting frame which includes a horizontally directed base member 26 and a vertically directed framework 28 secured to the base member. As best seen in FIG. 1, the base member includes a forward extension 30 generally underlying the plenum chamber, and a transverse plate 32 is carried at the forward end of the extension.

The plate in turn carries a hinged bracket 34 on the top surface thereof for the purposes hereinafter set forth, and a pair of casters 35 are carried on the bottom surface of the plate 32 to portably support the apparatus on the floor. The extension 30 includes an offset at 36 such that the extension is positioned at a minimum elevation above the floor to thereby insure that any hospital bed may be rolled thereover as shown in FIG. 1.

Figure 2:
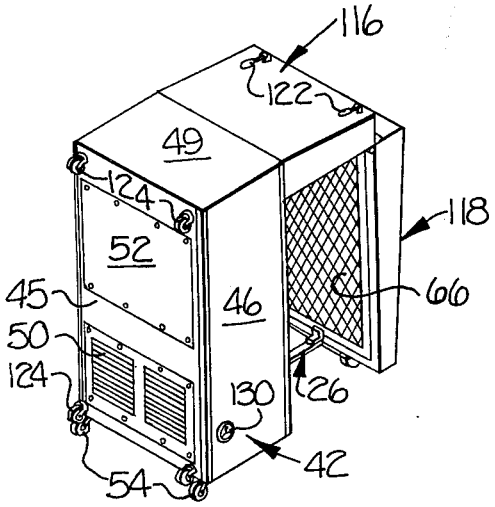
FIG. 2 is an isometric view of the air filtration apparatus shown in FIG. 1 and with the forward segment of the plenum chamber folded downwardly.

The framework 28 is mounted on the rear end portion of the base member 26, the framework comprising four rectangularly positioned uprights 38, 39, 40 and 41, and a number of interconnecting cross members (not numbered) to define a box-like arrangement. The framework 28 is covered by a plurality of overlying panels to define an enclosed housing generally indicated at 42, and in particular there is provided a front vertical panel 44, a back vertical panel 45, side panels 46 and 47, a bottom panel 48 and a top panel 49. The back panel 45 includes a louvered removable plate 50 adjacent the lower end thereof to define an air inlet opening to the housing, and the front panel 44 terminates below the top panel 49 to define a horizontally directed air panel 45 further includes a removable cover plate 52 as best seen in FIG. 2 to facilitate access to the interior of the housing for the purpose hereinafter set forth. Also, the lower end of the framework 28 mounts two additional casters 54 for supporting the apparatus on the floor.

Figure 4:
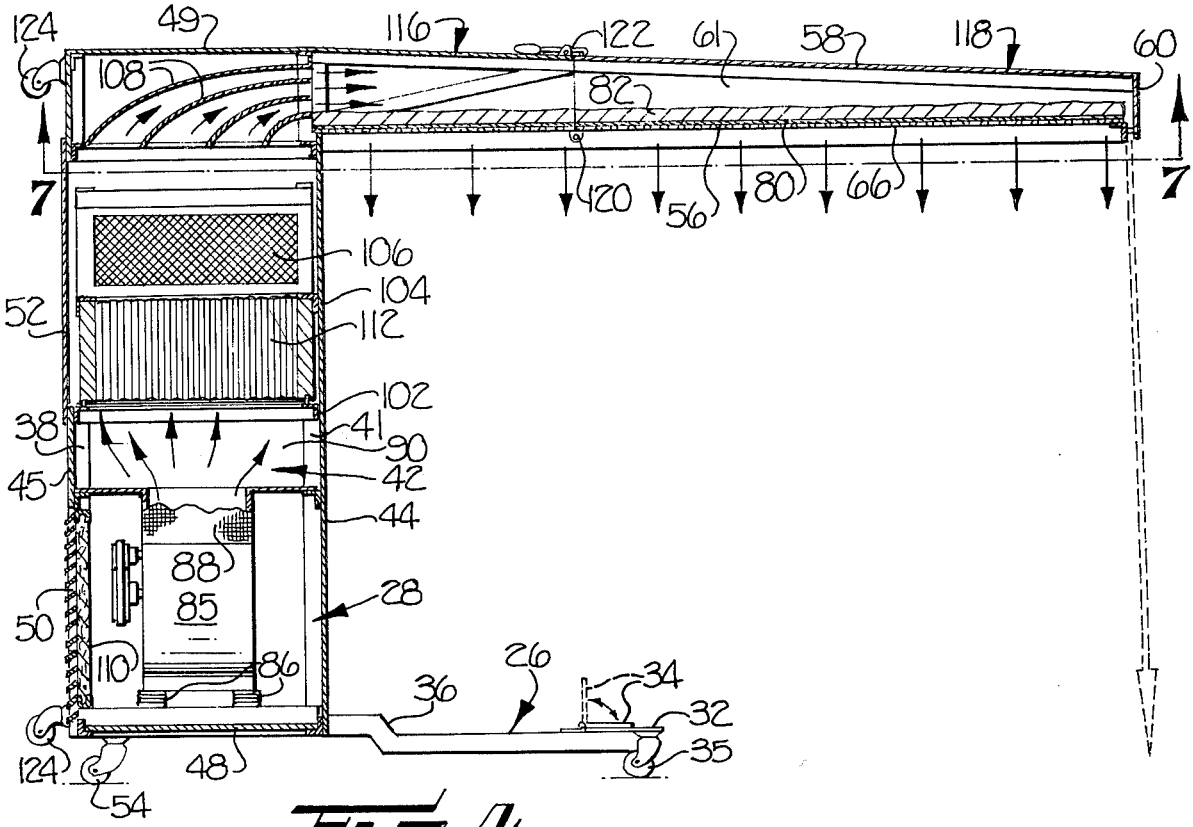
FIG. 4 is a sectional side elevational view of the apparatus taken along the line 4—4 of FIG. 1.
Figure 5:
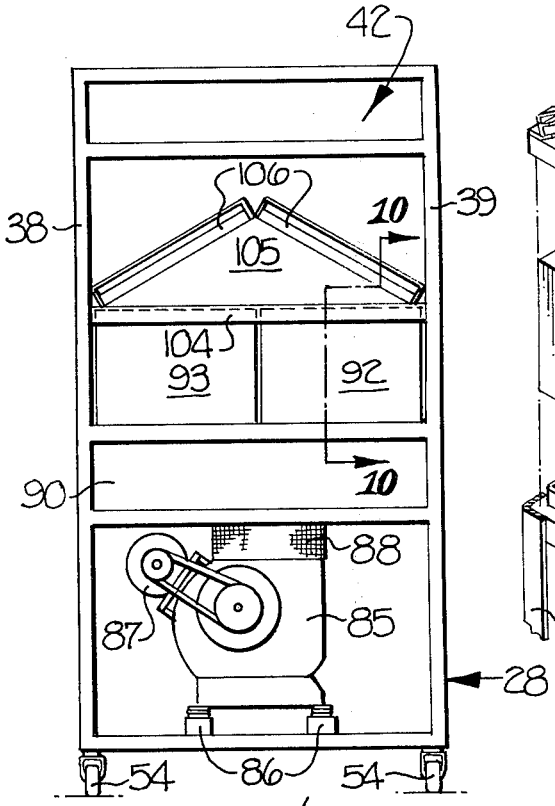
FIG. 5 is a rear elevational view of the apparatus with the back panel of the housing removed to illustrate the interior placement of the air circulation system.

The plenum chamber 22 comprises a generally planar bottom wall 56, a generally planar top wall 58, a front wall 60 interconnecting the bottom and top walls to define a closed front end, and side walls 61 and 62 interconnecting the bottom wall and top wall along opposite sides thereof to define closed sides. The bottom wall 56, top wall 58, and side walls 61, 62 further define an open rear end of the plenum chamber which, as seen in FIG. 4, is in fluid communication with the air outlet opening of the housing 42. Also, the walls 60, 61, and 62 define coplanar lower edges 63, 64, and 65 respectively.

Figure 7:
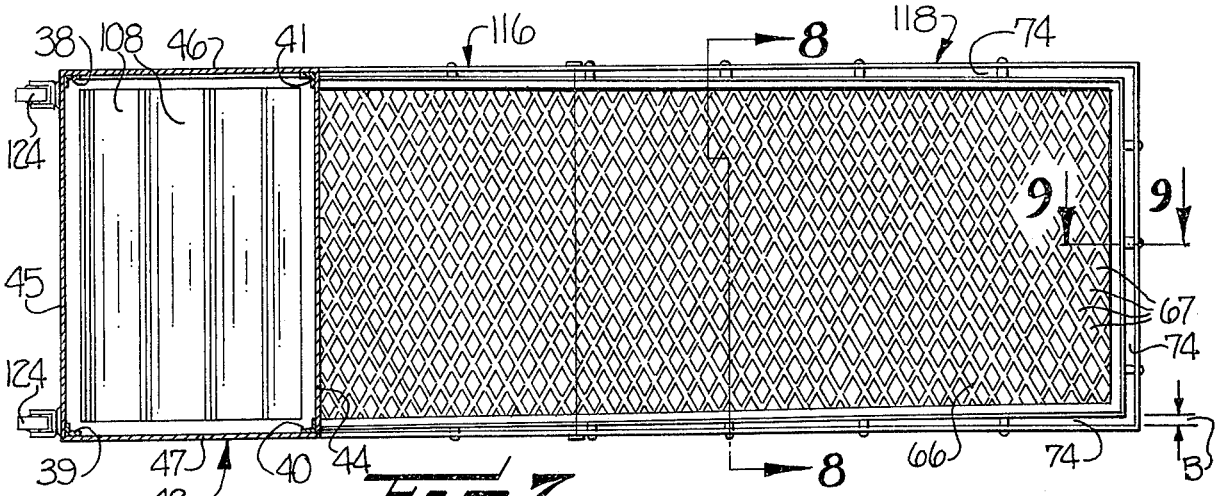
FIG. 7 is a bottom sectional view taken along the line 7—7 of FIG. 4.

The bottom wall 56 of the plenum chamber comprises a net-like expanded metal screen 66 (note FIG. 7) which defines a plurality of substantially uniformly spaced openings 67 extending therethrough, the openings 67 being distributed throughout substantially the entire area of the bottom wall. The openwork screen 66 is generally rectangular and defines a rear edge (along the left hand end as seen in FIG. 7), a front edge (along the right hand end), and opposite side edges (along the upper and lower sides). A downwardly directed flange 68 extends along the front edge and the two side edges, the flange including a relatively short horizontal leg 70 and a longer vertical leg 71 in cross section. The flange 68 is spaced from the front wall 60 (note FIG. 9) and side walls 61, 62 (note FIG. 8) of the plenum chamber to define a downwardly directed, continuous, open slot 74 extending along each side and the front end of the plenum chamber, with the vertical leg 71 serving as the inside lip of the slot and the lower portion of the walls 60, 61, and 62 serving as the outside lip. In addition, the vertical leg 72 of the flange includes a planar lower edge 76 which lies somewhat below the lower edges 63, 64, and 65 of the front wall and side walls respectively, and for the purposes hereinafter set forth. The vertical separation between the lower edge 76 and edges 63, 64, and 65 is represented by the letter A, and is about ⅛ inch. Also, it will be noted from FIG. 7 that the slot 74 is slightly tapered along both side walls such that the gap is somewhat less adjacent the open rear end than it is adjacent and along the front wall 60. In the illustrated apparatus, the gap is about 3/32 inches adjacent the rear end and about 7/32 inches adjacent and along the front wall, representing a taper B of about 2 ½°.

Figure 8:
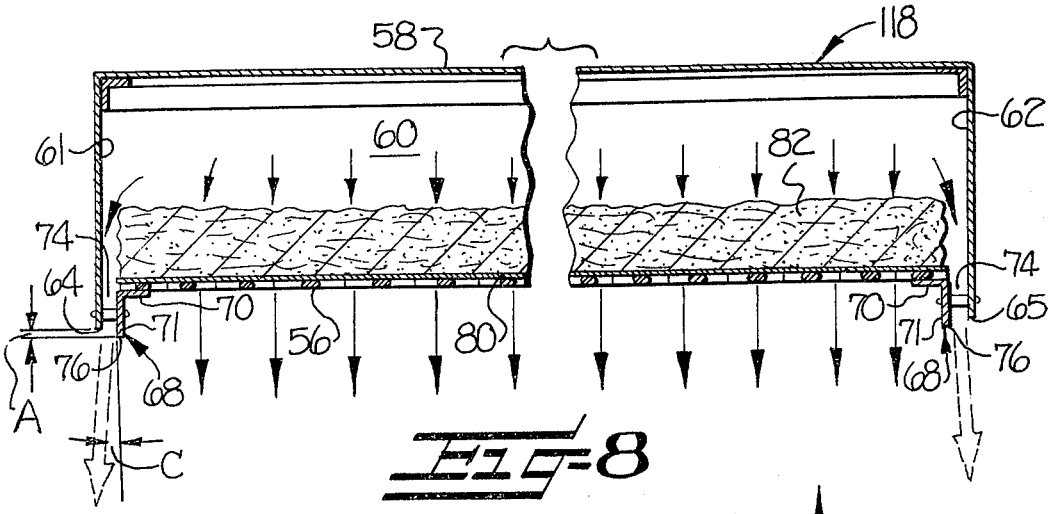
FIG. 8 is a sectional view taken substantially along the line 8—8 of FIG. 7.
Figure 9:
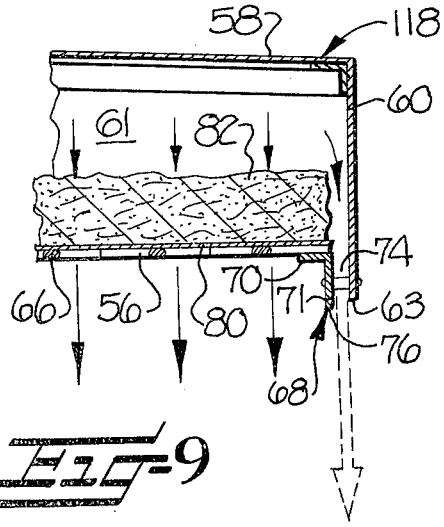
FIG. 9 is a fragmentary sectional view of the closed front end of the plenum chamber and taken substantially along the line 9—9 of FIG. 7.

As seen in FIG. 8, air permeable means is positioned upon and substantially covers the screen 66 and is adapted to slow the passage of air downwardly therethrough and to guide the same into a substantially laminar flow pattern. More particularly, the air permeable means comprises a sheet of high efficiency filtering media 80 overlying the openwork screen, and a nonwoven pad 82 of loose fibers and of a thickness of about 2 inches overlying the sheet of filtering media. The high efficiency filtering media 80 is conventional in the art, and is of a very uniform construction so as to facilitate the formation of a substantially laminar flow pattern therethrough and as hereinafter further described.

The top wall 58 of the plenum chamber is positioned in spaced relation above the bottom wall 56, and as best seen in FIG. 4, the top wall is inclined in relation to the bottom wall such that the spacing is greater at the rear end of the plenum chamber than at the front end. More specifically, the top wall lies parallel to the bottom wall along the lateral direction extending from side to side, but is inclined in relation to the bottom wall along the longitudinal direction.

The housing 42 of the illustrated apparatus 20 stands about 76 inches high, and the plenum chamber 22 is about 88 inches long. The vertical spacing between the top and bottom walls of the plenum chamber is about 9 inches adjacent the rear end and about 5 ½ inches adjacent the front end representing an incline of about 2 and ½°. By this arrangement, a substantially uniform static pressure is obtained along the length of the plenum chamber to thereby achieve a substantially uniform air distribution along its length as hereinafter further explained.

The filtration apparatus 20 of the present invention further comprises blower means positioned within the housing 42 for directing filtered air under pressure outwardly through the air outlet opening and into the open rear end of the plenum chamber. More particularly, the blower means includes a conventional air blower 85 mounted upon vibration isolaters 86 at the bottom of the housing, and an electric motor 87 operatively connected to the blower 85. For the reasons hereinafter set forth, the electric motor 87 is able to have a relatively low power consumption and may be operated on a standard household current of about 115 volts to power the blower for delivery of about 1500 cfm. Preferably, the motor is operable at two selected speeds, and utilizes about 1000 watts of power (3/4 HP).

Figure 6:
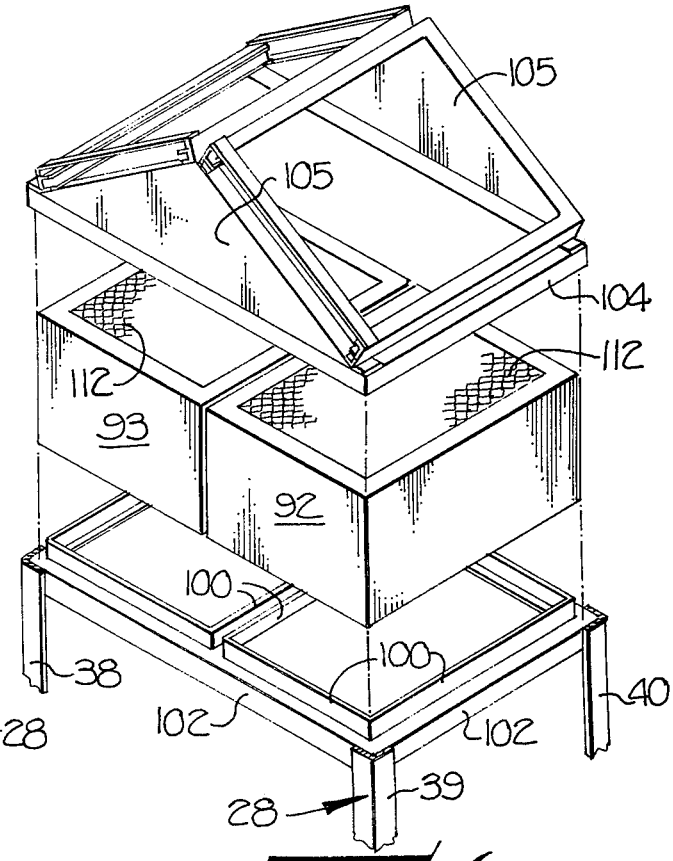
FIG. 6 is an exploded isometric view of the mounting structure for the high efficiency filters, as well as the activated charcoal filters.
Figure 10:
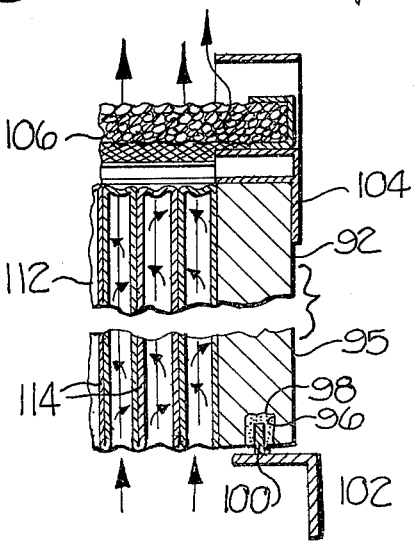
FIG. 10 is a fragmentary sectional view taken substantially along the line 10—10 of FIG. 5, and illustrating the structure of the filter pack of the air filter, and the means for sealably mounting the same in the housing.

A flexible fabric connector 88 directs the air from the blower into an open distribution box 90, the flexible fabric of the connector serving to further isolate the vibration of the blower from the housing. If desired, the distribution box 90 and the lower portion of the housing may be lined with a suitable acoustic material (not shown) to attenuate the noise of the blower. From the distribution box 90, the air passes upwardly through a pair of adjacent high efficiency filters 92, 93 which are sealably mounted in the housing as best seen in FIGS. 6 and 10. In particular, each of the filters 92, 93 comprises a rectangular frame 95 having a centrally disposed air flow opening (not numbered) therethrough.

A continuous circumferential channel 96 is positioned in the front face of the filter frame and surrounds the air flow opening, and a fluid 98 having a consistency similar to that of petrolatum substantially fills the channel. A pair of rectangular retainers 100 are mounted upon the cross members 102 and in sealing engagement with the housing, each of the retainers having a cross sectional configuration corresponding to that of the channel 96 of the filter frame such that the forward portion of the retainer 100 is positioned within the channel and extends into the fluid 98 when the filter is moved downwardly onto the retainer to the position shown in FIG. 10. A fluid seal arrangement of this type is further described in U.S. Pat. No. 3,529,406. An upper rectangular clamping 104 is releasably secured within the housing to maintain the assembly of the two filters on their respective retainers. The clamping frame 104 further includes an inverted V-shaped receptacle 105 for mounting two activated charcoal filters 106 which serve to remove odors from the air passing therethrough.

The upper end of the housing 42 further mounts a plurality of arcuate turning vanes 108 for directing the upwardly flowing air horizontally through the outlet opening and into the open rear end of the plenum chamber. By employing a plurality of spaced vanes in the manner shown in FIG. 4, a substantially uniform distribution of air can be obtained in both the horizontal and vertical directions as the air enters the plenum chamber.

As noted above, the louvered plate 50 on the back panel is removable to permit access to the blower 85 and motor 87 for any required servicing. In addition, the plate 50 mounts a prefilter 110 immediately behind the opening. The prefilter 110 is conventional and is designed to remove the relatively large particles from the air, and thereby serves to reduce the time period between changes of the high efficiency filters 92, 93. In this regard, it will be noted that the filters 92, 93 are easily changed by removing the cover plate 52 of the back panel, and then releasing the clamping frame 104. The old filters may be then easily lifted and withdrawn and new filters inserted.

Preferably, the air filters have a low resistance to the air passing therethrough to thereby permit the use of the above described relatively small electric motor 87 and also reduce the overall size of the apparatus 20. To obtain the desired low resistance, a unique filter of the type shown in FIGS. 6 and 10 may be employed. In particular, the illustrated filter comprises a filter pack 112 disposed within and filling the air flow opening, the filter pack comprising a sheet of pleated or corrugated high efficiency filtering media folded in accordion fashion with the folds 114 extending generally parallel to the direction of air flow therethrough. It should be particularly noted that the adjacent folds are in direct contact with each other and are held apart by the vertical corrugations. Thus there are no separators between adjacent folds. It has been found that the use of such "separatorless" filters decreases the air resistance by up to 25 percent in an 11 ½ inch deep filter, as compared to conventional filters of the same size employing separators between the folds, since the elimination of the filters results in a greater effective filtering area. For a detailed description of a method of making the above filter, reference is made to U.S. Pat. No. 3,540,079.

The filters 92, 93 are preferably constructed from a high efficiency filtering media which is capable of removing extremely high percentages of submicron sized particles from the air. Specifically, it is preferred to use "absolute" filtering media and wherein the filters are adapted to remove 99.97 percent of the airborne particles down to 0.3 microns in size. Such filtering media is well known in the art. Together, the two filters 92, 93 occupy an area of about 6 square feet within the housing, and the filter pack in each filter is about 11 ½ inches deep. Obviously, a single filter of these dimensions could be substituted for the illustrated pair of filters.

Figure 3:
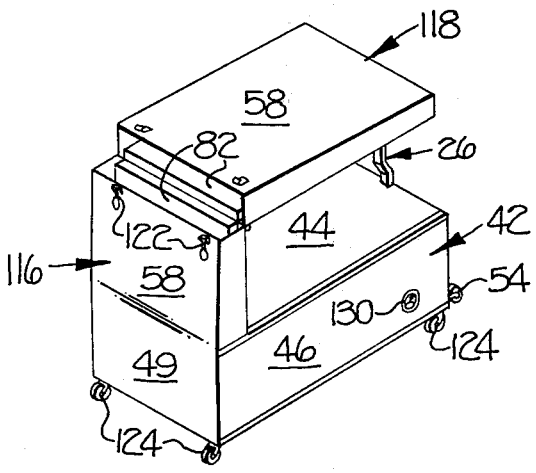
FIG. 3 is a view similar to FIG. 2, but showing the apparatus rotated onto its back wall to facilitate movement and storage.

As a further aspect of the present invention, the plenum chamber 22 is divided into two segments, namely, the rear segment 116 and the forward segment 118. The two segments are interconnected by a hinge 120 such that the forward segment 118 may be moved or folded about a transverse axis between a first operative horizontal position in alignment with the rear segment 116 and as shown in FIG. 4, or a second non-operative downwardly directed position as shown in FIGS. 2 and 3. A pair of latch members 122 are carried along the top wall 58 of the plenum chamber to releasably maintain the forward segment 118 in its first operative horizontal position.

As noted above, the plenum chamber 22 of the illustrated apparatus has a total length of about 88 inches, and the forward segment has a length of about 60 inches and the rear segment has a length of about 28 inches. Thus the forward segment is about twice the length of the rear segment, and the forward segment is designed to contact the hinged bracket 34 when the bracket is raised.

As seen in FIG. 2, the back panel 45 of the housing 42 mounts a second set of casters 124. Thus if desired, the entire apparatus may be rotated 90° rearwardly such that it is supported on the floor by the second set of casters 124 in the manner shown in FIG. 3. In this configuration, the hinged bracket 34 contacts the downwardly directed forward segment 118 of the plenum chamber to limit its pivotal movement and prevent its striking the front panel 44. Also, when in this configuration, the apparatus has an overall height of about 68 inches. Thus the total height of the apparatus may be significantly reduced to thereby facilitate movement of the apparatus through doors, elevators and the like, and for shipment. The casters 124 further serve as spacing means to keep the lower air inlet at 50 an adequate distance from adjacent walls to thereby insure free air entry.

The illustrated filtering apparatus 20 further includes a conventional extensible light fixture 126 mounted on the front panel 44 for use by the patient while lying on the bed 24. Also, an on-off switch 128 is positioned immediately above the light fixture. The switch 128 is connected by suitable circuitry (not shown) to the motor 87 and is designed to selectively operate the same at either a low speed. A conventional pressure gauge 130 is mounted on the side panel 46, the gauge serving to measure the pressure differential across the filters 92, 93 to thereby indicate when the loading of the filters becomes sufficient to require their replacement. In particular, as the airborne particles build up on the surfaces of the filter media, the pressure differential will increase, and when the differential reaches a predetermined level, the filters should be changed.

In operation, the motor 87 is energized by the switch 128 to selectively operate the blower at either high speed or low speed. In either case, air is drawn into the hosuing 42 through the air inlet opening at the louvered plate 50, and through the prefilter 110. From the blower, the air is directed upwardly through the distribution box 90, the high efficiency filters 92, 93, and then through the activated charcoal filters 106 to remove any odors. It will be noted that the activated charcoal filters are positioned downstream of the high efficiency filters to prevent a buildup of particles upon the charcoal filters. Upon reaching the upper end of the housing, the air is directed horizontally by the arcuate turning vanes 108 and into the open rear end of the plenum chamber with the air entering the plenum chamber being substantially uniformly distributed in both the horizontal and vertical directions.

Due to the uniform pressure produced by the tapered plenum, a first portion of the air entering the plenum chamber is forcibly directed downwardly through the pad 82, the sheet of filtering media 80, and then through the perforated screen 66 of the bottom wall 56. The pad 82 serves to reduce the initial turbulence of the air and linearizes the same for presentation to the filter media 80, and the uniform resistance filter media slows the air and further linearizes the direction of air movement to thereby produce a substantially laminar flow pattern of downwardly directed slow moving air. The illustrated taper of the plenum chamber serves to achieve a substantially uniform static pressure along its length to thereby obtain a substantially uniform flow of air through the entire area of the bottom wall.

A second portion of the air entering the plenum chamber is directed downwardly through the open slot 74 at a relatively high velocity to define an air curtain extending downwardly from the two sides and closed front end of the plenum chamber. Thus the area of the hospital bed is bounded on three sides by the air curtain, and on the fourth side by the vertical front panel 44 which extends downwardly from the rear end of the plenum chamber. The taper of the slot 74 along the sides (indicated generally at B) serves to increase the volume of air flow downwardly about the front end of the plenum chamber to thereby insure an adequate air curtain along the forward corners. In addition, the fact that the inside lip of the slot 74 extends below the outside lip serves to direct the curtain outwardly as indicated by the angle C to further guard against the incursion of unfiltered air into the area of the hospital bed.

With the motor 87 at low speed, the illustrated apparatus was found to produce a fairly uniform velocity of about 15 fpm beneath the bottom wall and over the entire area of the bottom wall. The velocities were measured by an Alnor velocity meter, with the probe thereof positioned about 3 inches below the bottom wall. At high speed, the velocity was uniform and averaged about 35 fpm throughout the length of the bottom wall.

The velocity of the air exiting through the slot 74 was also measured with the Alnor velocity meter, and in this case the probe was positioned about 12 inches below the slot. At low motor speed, the velocity averaged about 175 fpm, and at high speed, the velocity averaged about 350 fpm at all locations along the length of the plenum chamber. The angle C of the air curtain was also determined at both high and low speeds by attaching a strip of tissue paper adjacent the lip of the slot. At low speed the angle was about 5°, and at a high speed the angle was about 10°. The angle readings were consistent about the entire periphery of the slot.

The low speed operation of the apparatus is generally utilized in the case of patients with major burns or other cases of extreme sensitivity. At either speed however, it will be apparent from the above description that the apparatus 20 is adapted to substantially eliminate dust, pollen, and irritating particulate matter of all types from the vicinity of the patient. This clean and nearly sterile atmosphere has proven to be extremely helpful in the relief and treatment of bronchial patients with hay fever, asthma, emphysema, and bronchitis. Also, patients with poor defense mechanisms resulting for example from the treatment of leukemia or after surgery may be protected from secondary airborne infection with the apparatus of the present invention. In the case of patients requiring life support facilities such as an intravenous bottle or the like, it will be noted that the net-like screen 66 of the bottom wall 56 serves the additional function of providing myriad attachment points for such equipment.

In the drawings and specification, there has been set forth a preferred embodiment of the invention, and although specific terms are employed, they are used in a generic and descriptive sense only and not for purposes of limitation.

That which is claimed is:

1. An apparatus for directing a filtered stream of air downwardly onto a predetermined area such as a hospital bed or the like, and with the periphery of the stream of air moving at a higher velocity than the central portion thereof to thereby form a peripheral air curtain to prevent the incursion of unfiltered air into the predetermined area and thus effectively isolate such area from the external environment while maintaining free access thereto, said apparatus comprising a horizontally disposed plenum chamber comprising a closed front end, an open rear end, opposite sides, perforated bottom wall means comprising an openwork screen and fibrous air permeable means resting upon and substantially covering said openwork screen for permitting air to be passed uniformly therethrough while reducing its velocity, and means defining a downwardly directed, continuous, open slot extending along each side and the front end and peripherally of said bottom wall means, means for supporting said plenum chamber above the predetermined area and in cantilever fashion from said open rear end such that the plenum chamber is unsupported along said sides and front end, a vertical panel extending downwardly from said rear end of said plenum chamber, and means for directing filtered air under pressure into said open rear end of said plenum chamber whereby a portion of the air is directed downwardly through said perforated bottom wall means at a relatively low velocity and the remaining portion of the air is directed downwardly through said slot at a relatively high velocity to define an air curtain and wherein the predetermined area is bounded by said air curtain and said vertical panel.

2. The apparatus as defined in claim 1 wherein said means for supporting said plenum chamber comprises a horizontal base member and a vertically directed box-like framework extending upwardly from said base member, said vertical panel overlying one side of said framework, a plurality of additional panels overlying the other sides of said framework to define an enclosed housing, an air inlet opening adjacent the lower end of said housing, an air outlet opening adjacent the upper end of said housing and communicating with said open rear end of said plenum chamber, and wherein said means for directing filtered air into said open rear end of said plenum chamber is positioned within said housing.

3. The apparatus as defined in claim 2 whereing said air permeable means includes a sheet of high efficiency filtering media.

4. The apparatus as defined in claim 3 wherein said air permeable means further includes a non-woven pad of loose fibers and of substantial thickness overlying said sheet of filtering media.

5. The apparatus as defined in claim 2 wherein said apparatus further comprises means for directing the air passing through said slot outwardly to further resist the incursion of unfiltered air into the predetermined area.

6. The apparatus as defined in claim 2 wherein said plenum chamber further comprises a top wall positioned in spaced relation above said bottom wall means, said top wall being inclined in relation to said bottom wall means such that the spacing is greater at said rear end than at said front end to thereby provide a substantially uniform static pressure along the length of said plenum chamber.

7. The apparatus as defined in claim 2 wherein said means for directing filtered air under pressure into said open rear end of said plenum chamber comprises a blower positioned in said housing, and high efficiency air filter means positioned in said housing downstream of said blower.

8. An apparatus for directing a filtered stream of air downwardly onto a predetermined area such as a hosiptal bed or the like, and with the periphery of the stream of air moving at a higher velocity than the central portion thereof to thereby form a peripheral air curtain to prevent the incursion of unfiltered air into the predetermined area and thus effectively isolate such area from the external environment while maintaining free access thereto, said apparatus comprising a horizontally disposed plenum chamber positioned above said predetermined area, said plenum chamber comprising a. a bottom wall comprising an openwork screen, said screen defining a rear edge, a front edge, and opposite side edges, b. a top wall positioned in spaced relation above said bottom wall, c. a front wall interconnecting said bottom wall and said top along said front edge to define a closed front end, d. side walls interconnecting said bottom wall and top wall along said opposite side edges to define closed sides, said bottom wall, top wall, and side walls further defining an open rear end, and said front edge and side edges of said screen being spaced from said front wall and side walls respectively to define an open slot extending therebetween, and e. air permeable means resting upon and substantially covering said screen for slowing the passage of air downwardly therethrough and guiding the same into a substantially laminar flow pattern, said air permeable means comprising a sheet of high efficiency filtering media overlying said openwork screen, and a non-woven pad of loose fibers and of substantial thickness overlying said sheet of filtering media, support means for supporting said plenum chamber above said predetermined area, means for directing filtered air under pressure into said open rear end of said plenum chamber whereby the air passes downwardly through said air permeable means and openwork screen, and downwardly through said slot, with the air passing through said slot thus being at a higher velocity than the air passing through said screen to thereby form a high velocity peripheral air curtain extending downwardly from said front wall and side walls, and a vertical panel extending downwardly from said rear end of said plenum chamber such that the predetermined area is bounded by said air curtain and said vertical panel.

9. An apparatus for directing a filtered stream of air downwardly onto a predetermined area such as a hospital bed or the like, the periphery of the stream of air moving downwardly and somewhat outwardly and at a higher velocity than the central portion thereof to thereby form a peripheral air curtain to prevent the incursion of unfiltered air into the predetermined area and thus effectively isolate such area from the external environment while maintaining free access thereto, said apparatus comprising a horizontally disposed plenum chamber positioned above said predetermined area, said plenum chamber comprising a. perforated bottom wall means adapted to permit air to be passed therethrough in a substantially laminar flow pattern while slowing the same and defining a rear edge, a front edge, and opposite side edges, and a downwardly directed flange extending along said front edge and side edges, a top wall positioned in spaced relation above said bottom wall, said top wall being inclined at an angle of about 2 and 1/2 degrees in relation to said bottom wall means such that the spacing is greater at said rear edge than at said front edge, c. a front wall interconnecting said bottom wall and said top wall along said front edge to define a closed front end, said front wall including a lower edge, d. a side wall interconnecting said bottom wall and top wall along each of said opposite side edges to define closed sides, said bottom wall, top wall, and side walls further defining an open rear end of said plenum chamber, said side walls each including a lower edge lying in substantially the same plane as the front wall lower edge, said bottom wall flange being laterally spaced from said lower edges of said front wall and side walls to define an open slot extending therebetween, and said bottom wall flange including a planar lower edge extending at least about 1/8 inch below said lower edges of said front wall and side walls, support means for supporting said plenum chamber above said predetermined area, and means for directing filtered air under pressure into said open rear end of said plenum chamber whereby the air passes downwardly through said perforated bottom wall means and said slot, with the air passing through said slot thus being at a higher velocity than the air passing through said perforated bottom wall means and being directed outwardly by said flange lower edge to thereby form a high velocity air curtain extending downwardly and outwardly from said front wall and said side walls.

10. The apparatus as defined in claim 9 wherein the width of said slot is tapered along said sides with the width thereof being about 1/8 inch greater adjacent said front wall and along said front wall than it is adjacent said rear edge of said bottom wall such that a greater volume of air is adapted to pass through said slot adjacent said front wall.

11. An apparatus for directing a filtered stream of air downwardly onto a predetermined area such as a hospital bed or the like, and with the periphery of the stream of air moving at a higher velocity than the central portion thereof to thereby form a peripheral air curtain to prevent the incursion of unfiltered air into the predetermined area and thus effectively isolate such area from the external environment while maintaining free access thereto, said apparatus comprising a horizontally disposed plenum chamber comprising a closed front end, an open rear end, opposite sides, perforated bottom wall means for permitting air to be passed uniformly therethrough while reducing its velocity, and means defining a downwardly directed, continuous, open slot extending along each side and the front end, said plenum chamber being composed of a horizontally disposed rear segment and a forward segment, and hinge means for pivotally interconnecting said forward segment and rear segment to permit relative movement about a transverse axis such that the forward segment may be selectively maintained in a first operative horizontal position in alignment with said rear segment or a second non-operative downwardly directed position, means for supporting said plenum chamber above the predetermined area and in cantilever fashion from said open rear end such that the plenum chamber is unsupported along said sides and front end, said supporting means comprising a horizontal base member and a vertically directed box-like framework extending upwardly from said base member, a vertical panel overlying one side of said framework and extending downwardly from said rear end of said plenum chamber, a plurality of additional panels overlying the other sides of said framework to define an enclosed housing, an air inlet opening adjacent the lower end of said housing, and an air outlet opening adjacent the upper end of said housing and communicating with said open rear end of said plenum chamber, means positioned within said housing for directing filtered air under pressure into said open rear end of said plenum chamber whereby a portion of the air is directed downwardly through said perforated bottom wall means at a relatively low velocity and the remaining portion of the air is directed downwardly through said slot at a relatively high velocity to define an air curtain and wherein the predetermined area is bounded by said air curtain and said vertical panel, and first caster means carried by said base member for portably supporting the apparatus on a floor in its normal upright position, and second caster means carried by the side of said housing opposite said vertical wall for portably supporting the apparatus on a floor, such that the apparatus may be configured to facilitate movement through doorways or the like by pivoting said forward segment of said plenum chamber to its downwardly directed position and then rotating the entire apparatus 90 degrees rearwardly such that it is supported on the floor by said second caster means.

12. An apparatus for directing a filtered stream of air downwardly onto a predetermined area such as a hospital bed or the like, and with the periphery of the stream of air moving at a higher velocity than the central portion thereof to thereby form a peripheral air curtain to prevent the incursion of unfiltered air into the predetermined area and thus effectively isolate such area from the external environment while maintaining free access thereto, said apparatus being portable and collapsible to facilitate movement and storage thereof and comprising a horizontally disposed plenum chamber comprising a closed front end, an open rear end, opposite sides, perforated bottom wall means for permitting air to be passed uniformly therethrough while reducing its velocity, and means defining a downwardly directed, continuous, open slot extending along each side and the front end, said plenum chamber being composed of a horizontally disposed rear segment, a forward segment, and hinge means for pivotally interconnecting said forward segment and rear segment to permit relative movement about a transverse axis such that the forward segment may be selectively maintained in a first operative horizontal position in alignment with said rear segment or a second non-operative downwardly directed position, frame means for supporting said plenum chamber above the predetermined area and in cantilever fashion from said open rear end such that the plenum chamber is unsupported along said sides and front end, said frame means including a horizontally directed base member generally underlying said plenum chamber, and means carried by said base member for contacting said forward segment of said plenum chamber to limit the pivotal movement thereof beyond said second downwardly directed position, a vertical panel extending downwardly from said rear end of said plenum chamber, and means for directing filtered air under pressure into said open rear end of said plenum chamber whereby a portion of the air is directed downwardly through said perforated bottom wall means at a relatively low velocity and the remaining portion of the air is directed downwardly through said slot at a relatively high velocity to define an air curtain and wherein the predetermined area is bounded by said air curtain and said vertical panel.

13. The apparatus as defined in claim 12 wherein said frame means further comprises caster means carried by said base member for portably supporting the apparatus on a floor.

* * * * *

UNITED STATES PATENT AND TRADEMARK OFFICE

CERTIFICATE OF CORRECTION

PATENT NO. : 3,935,803

DATED : February 3, 1976

INVENTOR(S) : Louis Bush

It is certified that error appears in the above-identified patent and that said Letters Patent are hereby corrected as shown below:

Column 3, Line 24, after "directed air" insert --outlet opening as best seen in Figure 4. The back --;
Column 6, Line 45, after "height of" insert --only--;
Column 6, Line 60, after "speed" insert --or a high speed--;
Column 7, Line 4, correct the spelling of "housing";
Column 9, Line 11, correct the spelling of "wherein";
Column 9, Line 37, correct the spelling of "hospital";
Column 10, Line 40, before "a top wall" insert the sub-letter --b.--

Signed and Sealed this

*twenty-seventh* Day of *April 1976*

[SEAL]

*Attest:*

RUTH C. MASON
*Attesting Officer*

C. MARSHALL DANN
*Commissioner of Patents and Trademarks*